US008178802B2

(12) United States Patent
Roose et al.

(10) Patent No.: US 8,178,802 B2
(45) Date of Patent: May 15, 2012

(54) UNITIZED APPLIANCE CONTROL PANEL ASSEMBLY AND COMPONENTS OF THE ASSEMBLY

(75) Inventors: Lee A. Roose, Webster City, IA (US); William M. Monson, Webster City, IA (US); Michael P. Ricklefs, Webster City, IA (US); Steven J. Joerger, Ames, IA (US); Brian D. Ripley, Webster City, IA (US); Sean F. Myers, Ames, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 800 days.

(21) Appl. No.: 12/184,026

(22) Filed: Jul. 31, 2008

(65) Prior Publication Data

US 2010/0025214 A1 Feb. 4, 2010

(51) Int. Cl.
*H01H 9/00* (2006.01)

(52) U.S. Cl. ..... 200/296; 200/5 A; 200/5 R

(58) Field of Classification Search ..... 200/292–296, 200/5 A, 5 R, 512–520, 310–317
See application file for complete search history.

(56) References Cited

U.S. PATENT DOCUMENTS

| | | | |
|---|---|---|---|
| 2,914,705 | A | 11/1959 | Krystyan et al. |
| 3,512,427 | A | 5/1970 | Metcalf |
| 3,766,349 | A | 10/1973 | Codrino |
| 3,829,675 | A | 8/1974 | Mariani |
| 3,891,040 | A | 6/1975 | Schmitter |
| 3,968,336 | A | 7/1976 | Johnson |
| 3,969,595 | A | 7/1976 | Johnson |
| 3,990,166 | A | 11/1976 | Nagelkirk |
| 4,013,855 | A | 3/1977 | Reichen et al. |
| 4,163,883 | A | 8/1979 | Boulanger |
| 4,179,594 | A | 12/1979 | Coyle et al. |
| 4,180,847 | A | 12/1979 | Cresko et al. |
| 4,241,382 | A | 12/1980 | Daniel |
| 4,262,182 | A | 4/1981 | Basler et al. |
| 4,311,359 | A | 1/1982 | Keller |
| 4,321,655 | A | 3/1982 | Bouvrande |

(Continued)

FOREIGN PATENT DOCUMENTS

| | | |
|---|---|---|
| CN | 1542205 | 11/2004 |

(Continued)

OTHER PUBLICATIONS

Electrolux Assembled Photos of Related Art Appliance Control Panel Components.

*Primary Examiner* — Renee S Luebke
*Assistant Examiner* — Marina Fishman
(74) *Attorney, Agent, or Firm* — Banner & Witcoff, Ltd

(57) ABSTRACT

An electronics enclosure and associated components form a self-contained, unitized assembly including control buttons and illuminated indicator elements, that can be mated as a single piece with an outer user interface control panel fascia. A front panel of the electronics enclosure provides a mounting location for various buttons and lighted indicators that will show through mating apertures provided in the control panel fascia. This may include light pipe collars and integral spring levers. Specially configured cup structures may be integrally molded at the ends of the spring levers to provide electrostatic discharge (ESD) protection. A mount of planar spring button pieces on the front enclosure panel, over the associated spring levers, results in an assembly incorporating two springs serving to bias the associated button to its return position, and eliminating any rattle or looseness of the parts.

21 Claims, 15 Drawing Sheets

U.S. PATENT DOCUMENTS 4,376,879 A 3/1983 Nagata et al.
4,414,452 A 11/1983 Denley
4,427,879 A 1/1984 Becher et al.
4,489,227 A 12/1984 Lamarche
4,562,832 A 1/1986 Wilder et al.
4,589,026 A 5/1986 Ozawa et al.
4,590,342 A 5/1986 Schlegel
4,605,990 A 8/1986 Wilder et al.
4,692,987 A 9/1987 Cuthbert et al.
4,743,820 A 5/1988 Veach
4,772,769 A 9/1988 Shumate
4,796,985 A 1/1989 Onanian
4,800,466 A 1/1989 Bauer et al.
4,812,029 A 3/1989 Onanhian
4,858,086 A 8/1989 Pietrantonio et al.
4,885,443 A 12/1989 Simcoe et al.
4,903,171 A 2/1990 Livezey
4,930,048 A 5/1990 Ito
4,935,856 A 6/1990 Dragoon
4,946,242 A 8/1990 Tanno et al.
5,039,832 A 8/1991 Polacek et al.
5,063,479 A 11/1991 Satoh
5,130,761 A 7/1992 Tanaka
5,165,530 A 11/1992 Shinohara et al.
5,198,283 A 3/1993 Hausler et al.
5,219,135 A 6/1993 Scott
5,252,798 A 10/1993 Kamada
5,257,448 A 11/1993 Pearce et al.
5,263,271 A 11/1993 Cox et al.
5,268,823 A 12/1993 Yergenson
5,280,145 A 1/1994 Mosier et al.
5,281,158 A 1/1994 Lin
5,285,037 A 2/1994 Baranski et al.
5,321,790 A 6/1994 Takahashi et al.
5,327,328 A 7/1994 Simms et al.
5,336,859 A 8/1994 Wojtanek et al.
5,339,223 A 8/1994 Kremenchugsky et al.
5,347,123 A 9/1994 Jackson et al.
5,364,065 A 11/1994 Tauati
5,387,023 A 2/1995 Deneau
5,394,863 A 3/1995 Sanford et al.
5,464,955 A 11/1995 Cole
5,529,570 A 6/1996 Storz
5,537,300 A 7/1996 Kraines et al.
5,538,425 A 7/1996 Reeves et al.
5,555,161 A 9/1996 Roe et al.
5,564,769 A 10/1996 Deneau et al.
5,584,563 A 12/1996 Stottmann
5,603,283 A 2/1997 Owen
5,611,609 A 3/1997 Katz et al.
5,611,610 A 3/1997 Katz et al.
5,613,750 A 3/1997 Roe
5,679,304 A 10/1997 Watanabe et al.
5,685,623 A 11/1997 Katz et al.
5,698,826 A 12/1997 Cracraft et al.
5,738,424 A 4/1998 Katz et al.
5,768,459 A 6/1998 Wolter et al.
5,812,730 A 9/1998 Snyder
5,861,589 A 1/1999 Sato et al.
5,883,994 A 3/1999 Snyder
5,895,115 A 4/1999 Parker et al.
5,938,324 A 8/1999 Salmon et al.
5,975,711 A 11/1999 Parker et al.
6,019,478 A 2/2000 Pizzo
6,045,249 A 4/2000 Bellinghausen et al.
6,075,214 A 6/2000 Sato et al.
D428,659 S 7/2000 Sonderegger et al.
6,099,152 A 8/2000 Naganawa et al.
6,100,484 A 8/2000 Houze et al.
6,111,207 A 8/2000 Arterberry et al.
6,130,386 A 10/2000 Jorczak
6,136,386 A 10/2000 Nakahigashi et al.
6,176,589 B1 1/2001 Ishiguro
6,185,356 B1 2/2001 Parker et al.
6,204,459 B1 3/2001 Kizele et al.
6,290,382 B1 9/2001 Bourn et al.
6,335,499 B1 1/2002 Kokubu et al.
6,336,732 B1 1/2002 Shiau
6,344,622 B1 2/2002 Takiguchi et al.
6,390,320 B2 5/2002 Hurst et al.
6,394,619 B1 5/2002 Snider
6,507,967 B2 1/2003 Johnson
6,523,976 B1 2/2003 Turnbull et al.
6,552,282 B2 4/2003 Lewis
6,590,170 B1 7/2003 Jenkins
6,590,174 B2 7/2003 Zysnarski et al.
6,610,943 B1 8/2003 Durfee et al.
6,621,717 B2 9/2003 Tuttle et al.
6,727,443 B2 4/2004 Peterson et al.
6,737,596 B1 5/2004 Hein
6,743,993 B1 6/2004 Clark et al.
6,750,407 B2 6/2004 Song et al.
6,756,911 B2 6/2004 Striano et al.
6,759,613 B2 7/2004 Kurihara
6,765,158 B1 7/2004 Morrison et al.
6,766,103 B2 7/2004 Kim et al.
6,796,668 B2 9/2004 Parker et al.
6,856,841 B2 2/2005 Peterson
6,861,600 B1 3/2005 Schulz et al.
6,862,482 B2 3/2005 Peterson et al.
6,900,402 B2 5/2005 Lam et al.
6,900,404 B2 5/2005 Searle et al.
6,918,677 B2 7/2005 Shipman
6,946,610 B2 9/2005 Takeuchi et al.
6,969,186 B2 11/2005 Sonderegger et al.
7,038,156 B2 5/2006 Kim et al.
7,059,735 B2 6/2006 Orikasa
7,071,433 B2 7/2006 Holscher
7,075,024 B2 7/2006 Maeda et al.
7,091,932 B2 8/2006 Astrauskas
7,105,760 B2 9/2006 Zensai
7,117,179 B2 10/2006 Kim et al.
7,135,650 B2 11/2006 Jung
7,139,469 B2 11/2006 Kim et al.
7,156,632 B2 1/2007 Park et al.
7,156,635 B2 1/2007 Matson et al.
7,171,728 B2 2/2007 Chirumbolo
7,193,536 B2 3/2007 Shipman
7,201,508 B2 4/2007 Misaras
7,204,688 B2 4/2007 Han
7,222,979 B1 5/2007 Popowich et al.
7,244,898 B2 7/2007 Kim
7,338,141 B2 3/2008 Kang et al.
2001/0037933 A1 11/2001 Hunter et al.
2003/0024796 A1 2/2003 Peterson et al.
2003/0137264 A1 7/2003 Peterson et al.
2003/0142982 A1 7/2003 Peterson
2003/0150699 A1 8/2003 Song et al.
2005/0024330 A1 2/2005 Astrauskas
2005/0068788 A1 3/2005 Roth et al.
2005/0145468 A1 7/2005 Kim
2005/0178166 A1 8/2005 Kim et al.
2005/0178167 A1 8/2005 Kim et al.
2005/0183471 A1 8/2005 Kang et al.
2005/0193778 A1 9/2005 Park
2005/0194241 A1 9/2005 Kim
2005/0210926 A1 9/2005 Kwon et al.
2006/0016096 A1 1/2006 Kim
2006/0016676 A1 1/2006 Jung
2006/0039692 A1 2/2006 Lee et al.
2006/0155390 A1 7/2006 Corbett
2006/0164397 A1 7/2006 Bruntz et al.
2006/0207121 A1 9/2006 Lee
2006/0219697 A1 10/2006 Geiger et al.
2006/0290247 A1 12/2006 Lim et al.
2007/0018954 A1 1/2007 Cho et al.
2007/0152965 A1 7/2007 Krzyzanowski et al.

FOREIGN PATENT DOCUMENTS

JP 408024477 1/1996
JP 10235080 9/1998
JP 2001029691 2/2001
JP 2001157794 6/2001
JP 2001162092 6/2001
JP 2004073706 3/2004
JP 2004073708 3/2004
JP 2004121356 4/2004

| | | |
|---|---|---|
| JP | 2005168995 | 6/2005 |
| JP | 2006014927 | 1/2006 |
| JP | 2006288672 | 10/2006 |
| KR | 20030092190 | 12/2003 |
| KR | 20040011966 | 2/2004 |
| KR | 2005122510 | 12/2005 |
| KR | 2006031064 | 4/2006 |
| WO | 2005090868 | 9/2005 |

UNITIZED APPLIANCE CONTROL PANEL ASSEMBLY AND COMPONENTS OF THE ASSEMBLY

BACKGROUND OF THE INVENTION

The present invention relates to appliance control panel constructions, and particularly to constructions of control panels, switches and electronics assemblies and housings suitable for use in laundry appliances, such as automated laundry washing machines and dryers.

Automated laundry appliances (such as laundry washing machines and dryers) typically include an external generally rectangular cabinet, a control panel for controlling the washer/dryer operation, and a hinged lid or door that may be swung open to provide top or front-load access to a rotatable cylindrical wash basin (in the case of a washer). In use of an automated laundry washing machine, after placing a load of laundry in the wash basin, along with a suitable type and quantity of laundry detergent, a wash process is initiated by an operator through interaction with the control panel. Similarly, with a dryer, a wash load drying process is initiated through interaction with a control panel. The control panel provides a user interface through which a user may make selections of cycles and various wash (or dry) control parameters. Controlled operation sequences may be carried out using an electronic controller that may, e.g., be provided as an integral part of the control panel, or mounted separately and suitably connected therewith. Such a controller may comprise one or more suitably programmed microprocessors or application specific integrated circuits (ASICs), operably connected to suitable circuitry, e.g., for driving the wash basin drive motor, actuating operation components (e.g., valves and a pump) to fill the wash basin and drain it, dispense additives, etc. Such operations will be carried out in accordance with commands of the controller, generated on the basis of program control and possibly also signals received from various sensors monitoring various operation-related parameters.

In a modern trend, laundry appliances are taking on a more prominent stylistic role in the home. Along with this, greater emphasis is being placed on convenience, user friendliness and the "look and feel" of laundry appliances. To this end, greater use is being made of LED lighting and other control panel arrangements and features that may be more aesthetically attractive and easier to use. In addition, the range of functionalities and operation options provided in laundry appliances has increased appreciably. As more functionality is packed into a control panel, it becomes a greater and greater challenge to arrange the components for ease of use, e.g., for function and options selection. At the same time, the added complexity presents additional challenges from a manufacturing/assembly standpoint. A control panel construction capable of long term reliable operation, and that facilitates both consumer use and appeal, and the manufacture/assembly of the appliance, would be a significant contribution. Various efforts have been made in this regard.

Song U.S. Pat. No. 6,750,407 discloses, in a laundry appliance, a control panel assembly with operation buttons provided as part of a film applied to the outside of the control panel. An electronics enclosure is provided for retaining a PCB, and a "frame" in the form of a plate that overlays the PCB on its front. The frame provides light guiding supporters 54, and "intermediate buttons" in the form of planar springs. See FIGS. 2-3.

Kim et al. PGP 2005/0178167 discloses groups of "windows" flexibly joined (ganged) together so as to compensate for dimensional discrepancies in a control panel assembly.

Kim et al. PGP 2005/0178166 discloses non-illuminated button sleeve couplers ganging together (flexibly joining) a plurality of button sleeves and groups of button sleeves, to thereby compensate for dimensional discrepancies in a control panel assembly.

Kim PGP 2006/0016096 disclosures a control panel with an "LED window" provided with a "refracting member so as to exactly display light outside through the display hole." Abstract.

Kim PGP 2005/0145468 discloses an LED illuminated control panel assembly wherein an elastic button is coupled directly to the rear side of the front control panel (see, e.g., FIGS. 3 and 4).

SUMMARY OF SELECTED INVENTIVE ASPECTS

Aspects of the present invention provide a construction that unitizes the control panel electronics of a laundry appliance, i.e., washer or dryer. An electronics enclosure and associated components form a self-contained, unitized assembly, including control buttons and illuminated indicator elements that can be mated as a single piece with an outer user interface control panel (fascia). Such an arrangement can facilitate assembly during production, as well as disassembly for any maintenance/repair.

In another aspect of the invention, a front panel of the electronics enclosure provides a mounting location for various buttons and lighted indicators that will show through mating apertures provided in the control panel fascia. This may include light pipe collars and integral spring levers. An aspect of the integral spring levers is that raised surface portions extending in a closed loop are formed at the ends of the spring levers to surround, in spaced relation, a rearward contact portion of an associated push-button, and thereby serve to provide electrostatic discharge (ESD) protection to the underlying switch and printed circuit board (PCB).

Relatedly, a mount of planar spring button pieces on the front enclosure panel, over the associated spring levers with cups, results in an assembly incorporating two springs serving to bias the associated button to its return position. In addition to assuring a positive button return action, the second planar spring formed with the button serves to keep the button post and mating cup firmly engaged, to thus avoid rattle or looseness that might otherwise result from the play between the separate parts.

In a further aspect, the inventive construction provides, as a single molded part, a linear array of sleeves that, upon installation, surround a corresponding linear array of control panel operation buttons. The sleeves are light transmissive so as to provide decorative, button location identifying illuminated rings in the operation control panel of the appliance. Each sleeve is associated with a light pipe that extends rearwardly from the sleeve. The light pipe stem is sized and configured to place an end surface thereof directly in front of a corresponding light source, e.g., a printed circuit board (PCB) mounted light emitting diodode (LED). The light pipe may be provided in the form of a curved and tapered stem extending rearwardly from a cylindrical wall portion adjacent the rear cylindrical end of the sleeve.

In another aspect, the invention provides a push-button with an integrally formed planar spring mounting base, that may be backlit, such as by a PCB mounted LED. In the design, the elastic arms, which connect the button to a surrounding support, comprise linear segments extending at right angles to each other and tangentially of the button, so as to form rectangular inside corners. The button body includes a tubular (e.g., cylindrical) portion extending rearwardly from the depressible face of the button, through the spring plane and beyond the mounting base. The mounting base allows the button body to be mounted on the front panel of an electronics enclosure that houses the PCB.

The above and other objects, features and advantages of the present invention will be readily apparent and fully understood from the following detailed description of preferred embodiments, taken in connection with the appended drawings.

DETAILED DESCRIPTION OF EXEMPLARY EMBODIMENTS

Figure 1:
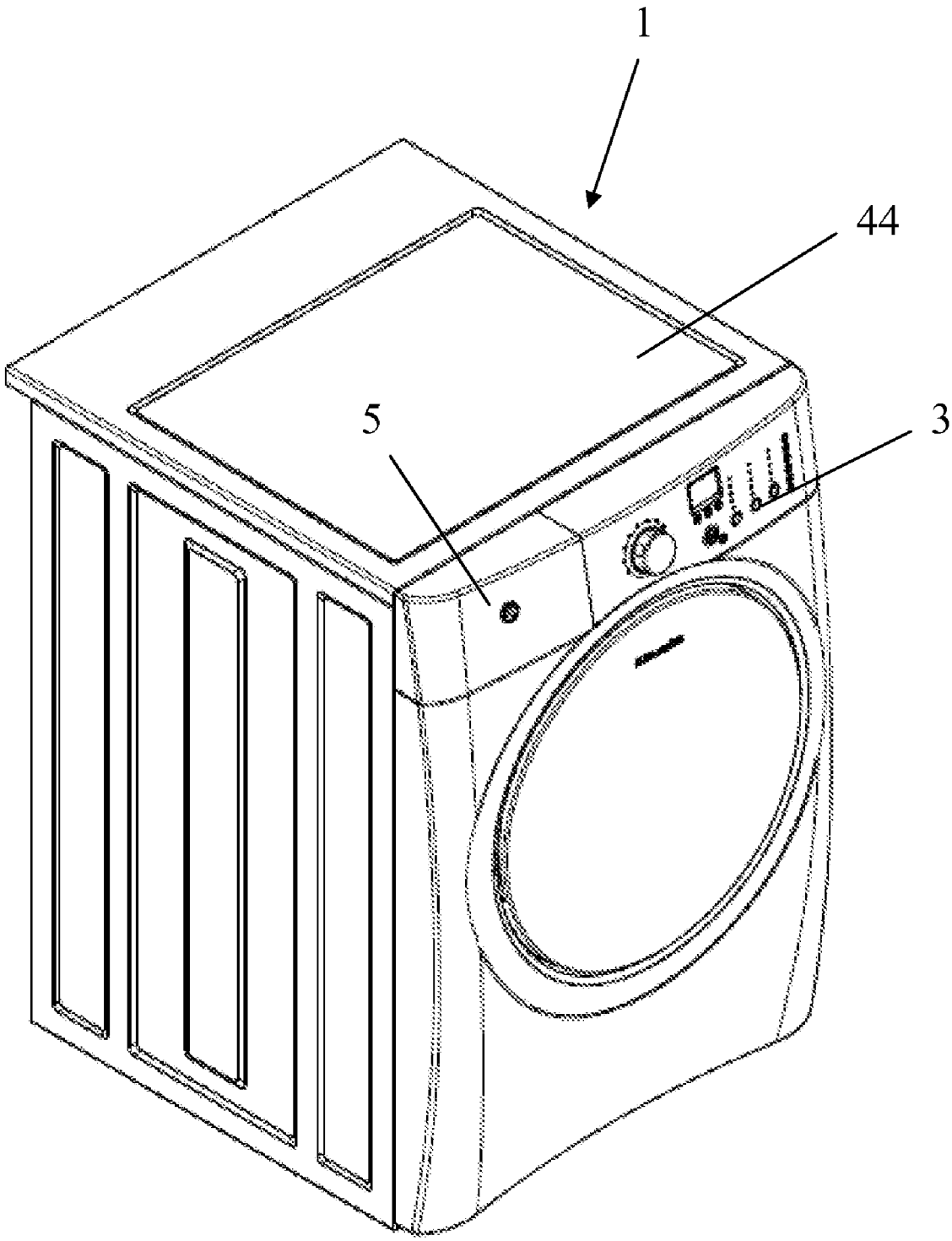
FIG. 1 is a frontal perspective view of a front load automatic laundry washer, including a control panel assembly in accordance with an aspect of the invention.

Referring to FIG. 1, illustrated is an exemplary laundry washing appliance (machine) 1 of the front-load, rotating drum variety. The washing machine includes a control panel 3 and an assembly of a drawer 5 and a housing cavity that receives the drawer alongside control panel 3 of the appliance. The drawer is extensible out of the housing to permit a user access to additive retention compartments of the drawer.

Figure 2:
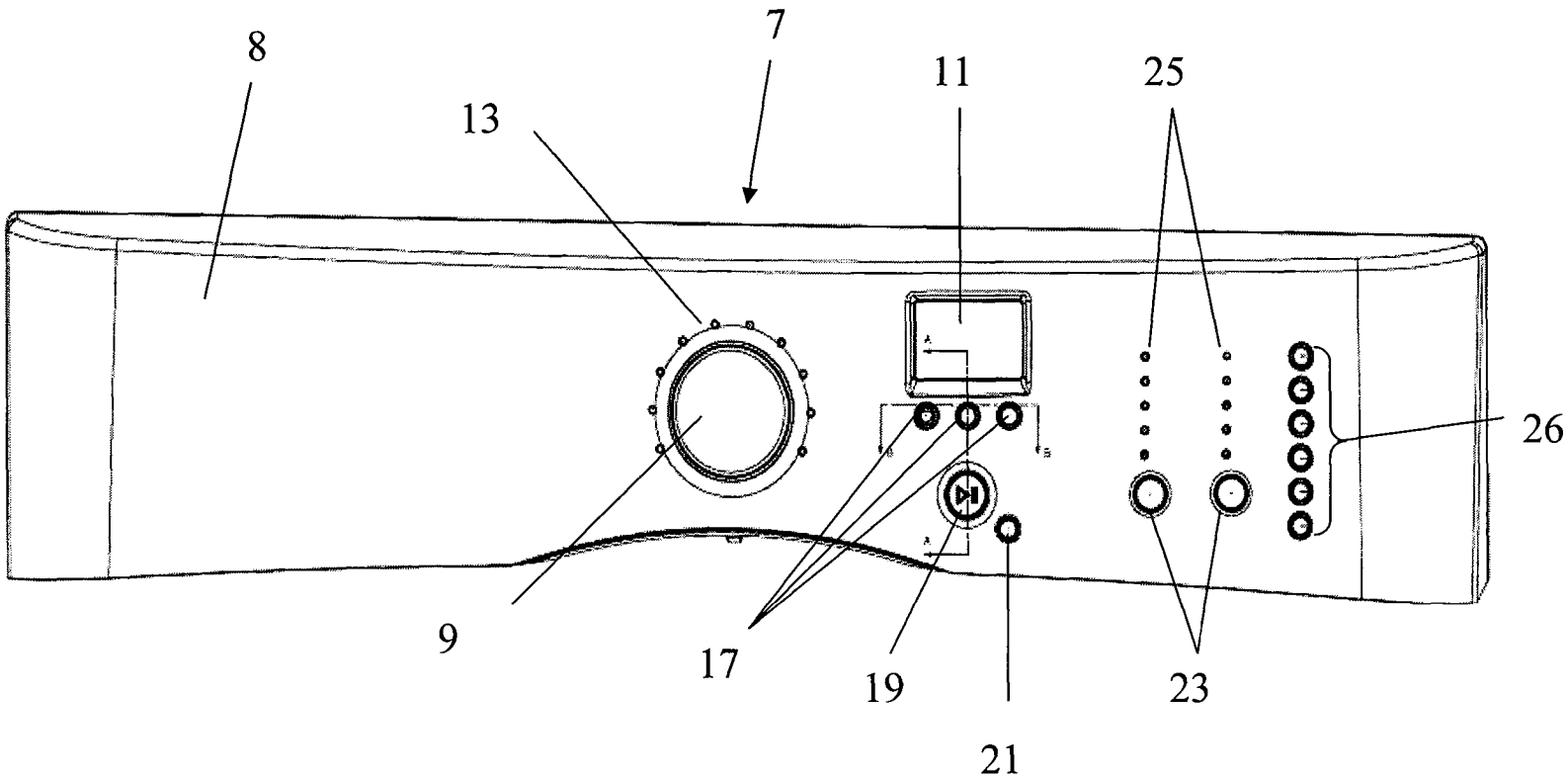
FIG. 2 is a front elevation view of an exemplary control panel assembly generally like the one shown installed in FIG. 1, but modified for use in a matching dryer (no hole for reception of additives drawer).

Referring now to FIG. 2, an exemplary control panel assembly 7 in accordance with the invention is shown. The control panel assembly includes a front fascia 8, which spans the width of the appliance. Received within, or in registry with, various apertures formed in the fascia 8 are a main control knob 9, an LCD display screen 11, and a plurality of operation push-buttons and illumination elements. The embodiment illustrated in FIG. 2 is generally like that seen in FIG. 1; a cavity for reception of an additives drawer is omitted, making it suitable for use in a front load laundry dryer that may be paired with the washer 1 shown in FIG. 1.

The illustrated main control knob 9 is rotatable in order to permit the user to select operation cycle settings and other control parameters, with reference to selections indicated by words, icons or other indicia that may be arrayed (in printed form or otherwise) on fascia 8 about the control knob. Illumination elements 13 are also arrayed about the control knob 9 to provide a visual indication of a particular operation selection corresponding to the knob position, the progression of which may be visually indicated on display screen 11. Alternatively, illumination of elements 13 may indicate the current operation state in the case of a progressive wash/dry operation comprising multiple sequential cycles or stages. As will be described, these and other illumination elements of control panel assembly 7 may comprise light pipes that serve to transmit light from a source behind the panel, such as printed circuit board (PCB) mounted light emitting diodes (LEDs), to the surface of the control panel fascia 8. A central shaft of the main control knob is operably connected to the shaft 14 of a rotary encoder (see FIG. 10). Main control knob 9 may be made moveable between an extended use position and a retracted non-use position, through use of a push-push actuation mechanism. The rotary encoder may be mounted on a recessed PCB surface, with its shaft 14 extending through the backside or bottom of a cup 15 (see, e.g., FIGS. 6 and 10) that receives the retractable knob 9 in its retracted position.

Figure 18B:
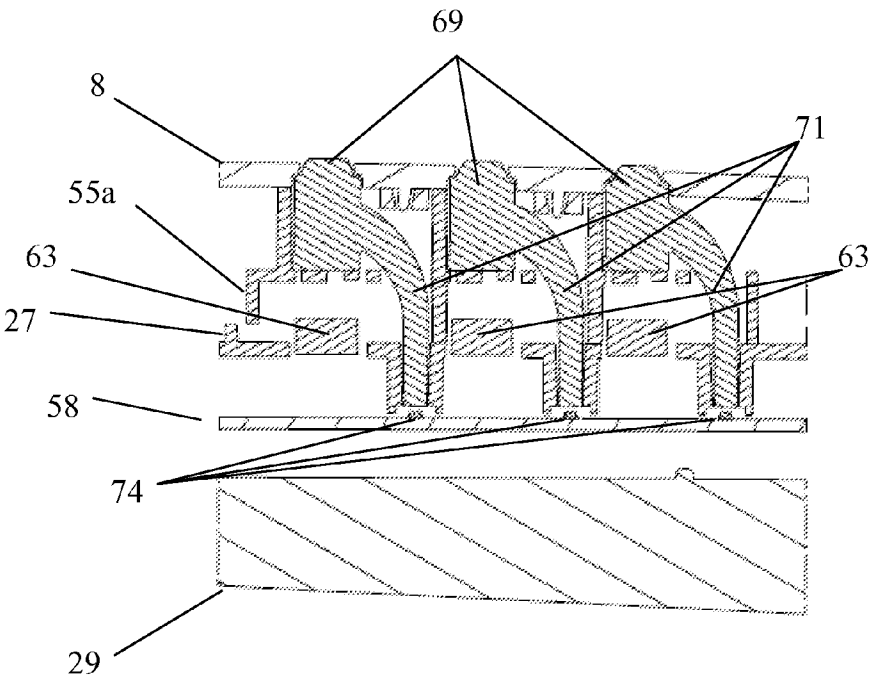
FIG. 18*b* is a section cut taken on the section line B-B shown in FIG. 2.

Option selections and input prompts may appear on the LCD screen display 11 as a result of program control executed by a CPU, ASIC or the like. Display screen 11 may be overlaid by a transparent window 16 (see FIGS. 10 and 18) attached to control panel fascia 8, so as to protect the display from moisture, chemicals, etc. Three horizontally arranged push-buttons 17 are located directly underneath the screen display 11, and may be used for operation control in conjunction with display 11. In exemplary embodiments, one of push-button 17 may be used to select a "favorite" setting of preselected commonly used cycles/modifiers/options, another one of buttons 17 is used to provide a control lock-out to avoid inadvertent actuation of a button or knob, and a third button 17 may be used to set the time for a time dry cycle of a dryer, or a delay-start feature of a washer.

A relatively large operation push-button 19 may be used as a main power switch control to turn the appliance on or pause the operation. A smaller push-button 21 next to that may serve as an operation cancel button.

Further to the right are a series of additional push-buttons 23 (e.g., two or three) of intermediate size. Above each of these buttons is a linear array of illumination elements, i.e., light indicators 25. The illustrated dryer embodiment of FIG. 2 has two buttons 23 and lines of indicators 25, whereas the illustrated washer embodiment (shown, e.g., in of FIGS. 1 and 5) has three of each. These may be used to indicate parameter selections made using the associated buttons, successive presses of which may serve to cycle through the available selections.

To the right side of buttons 23 and light indicator arrays 25 is a vertical linear array of small push-buttons 26. These may serve to allow user selection of additional options that may be added to the selected cycle. As will be described, push-buttons 17 and 26 may be surrounded by light transmitting sleeves providing rings of light about each button.

Figure 3:
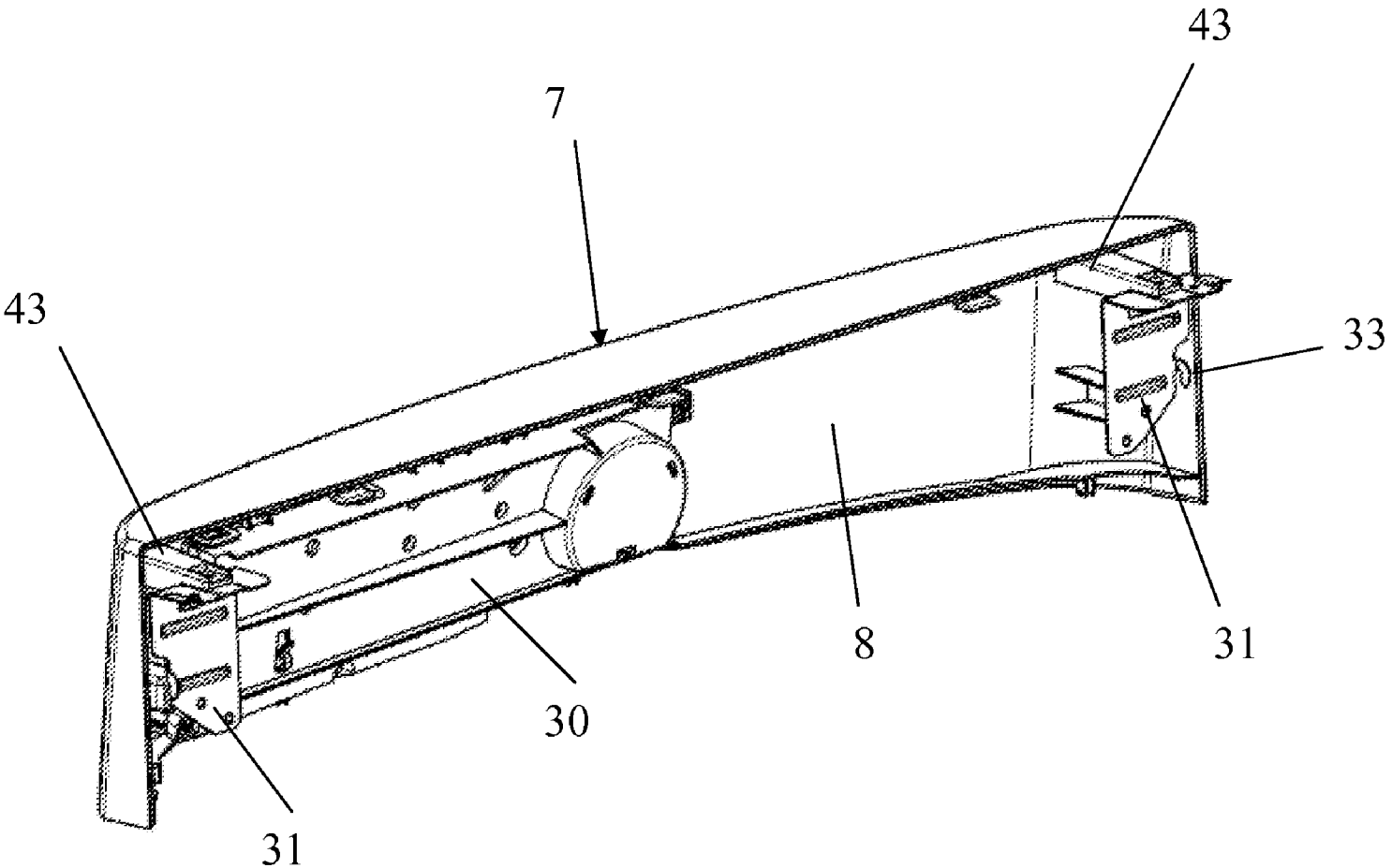
FIG. 3 is a rear side perspective view of the control panel assembly of FIG. 2.
Figure 4:
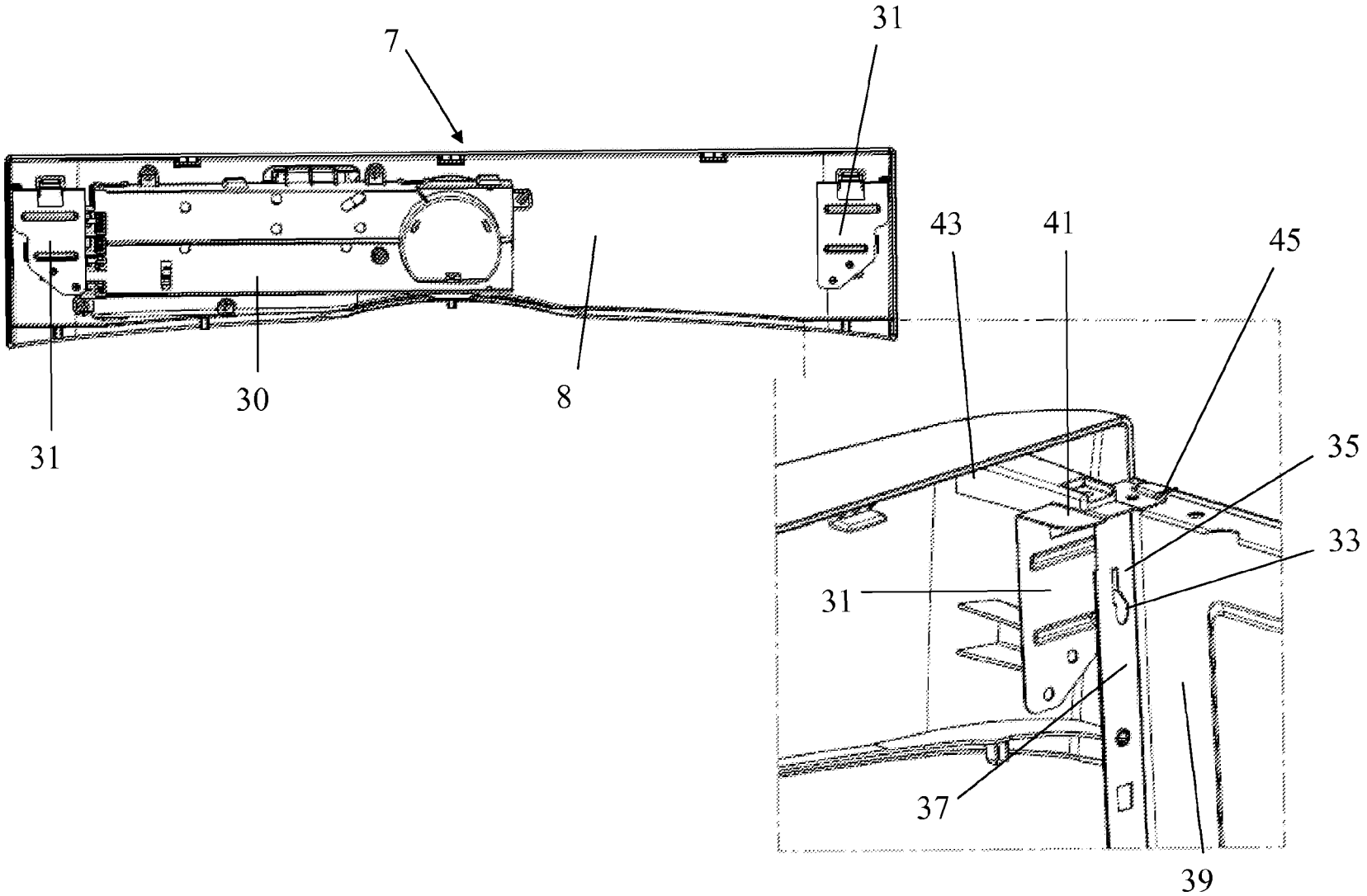
FIG. 4 is a rear elevation view of the control panel assembly of FIG. 2, with a corner mounting bracket thereof blown-up and shown in perspective.

In the present inventive arrangement, the various operation buttons and other control panel components are mounted on first and second a front enclosure panels 27, 28 which are mated with a rearward electronics enclosure housing 29 (see, e.g., FIG. 10), to form a unitized electronics assembly 30. See, e.g., FIG. 5. So assembled, unitized assembly 30, including electronics, control buttons, illuminated indicator elements, etc., can be mated as a single piece with the backside of outer control panel fascia 10, as seen in FIGS. 3 and 4. This avoids the need for a plurality of individual components, e.g., push-buttons, to be directly, individually mounted on the control panel fascia. Such an arrangement can facilitate assembly during production, as well as disassembly for any maintenance/repair.

Referring to FIGS. 3 and 4, an arrangement for mounting the thus formed complete control panel assembly 7 (fascia 8 and adjoined unitary package 30) to the frame of a laundry appliance is illustrated. A generally L-shaped metal corner bracket 31 is mounted at either end of control panel fascia 8 at its rearside, as seen in FIG. 3. As shown in FIG. 4, each corner bracket 31 is hung, by an engaging hook 33 and slot 35 arrangement, on an upper end portion of a front-facing flange 37 of a laundry appliance cabinet side panel 39. This provides an initial preplacement of the bracket 31 (and adjoined control panel assembly 7) on the laundry appliance frame, with a top flange 41 of the "L" extending horizontally inwardly in overlapping relationship with a top edge flange of the appliance side panel 39. The bracket top flange 41 has a hole for screw attachment of the bracket to the top edge flange of the side panel 39. Securement of control panel assembly 7 (more immediately, fascia 8 thereof) to bracket top flange 41 may be effected by a tab that extends forwardly into engaging relationship with a slot provided in a rearwardly directed mounting arm 43 attached to the control panel fascia 8. Final securement may be provided by a threaded fastener (e.g., screw) passing through aligned holes of the mounting arm 43 and bracket top flange. An underside recess 45 extending from the rear edge of the flange and along the side overlapping with the top edge flange of the side panel 39 may provide a retention feature for capturing a horizontal flange on the top panel 44 (FIG. 1) of the appliance. Thus, the single corner bracket provides a structural connection between three components which come together at the two top forward corners of the appliance cabinet—the control panel assembly 7, the side panel 39 and the top panel 44.

Figure 5:
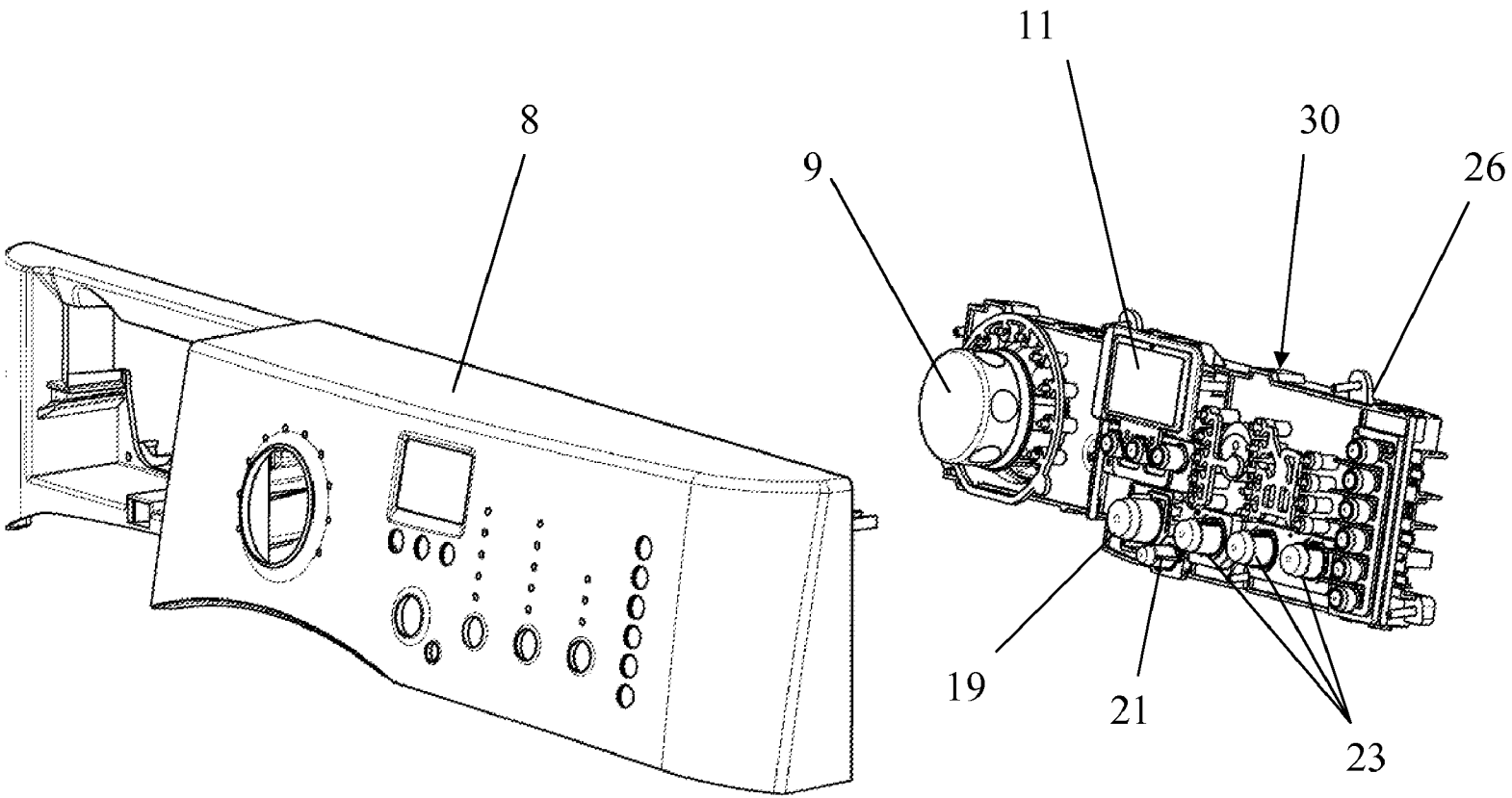
FIG. 5 is a first level exploded perspective view showing a unitized assembly of control panel parts separated rearwardly from the washer control panel fascia with which it mates.
Figure 10:
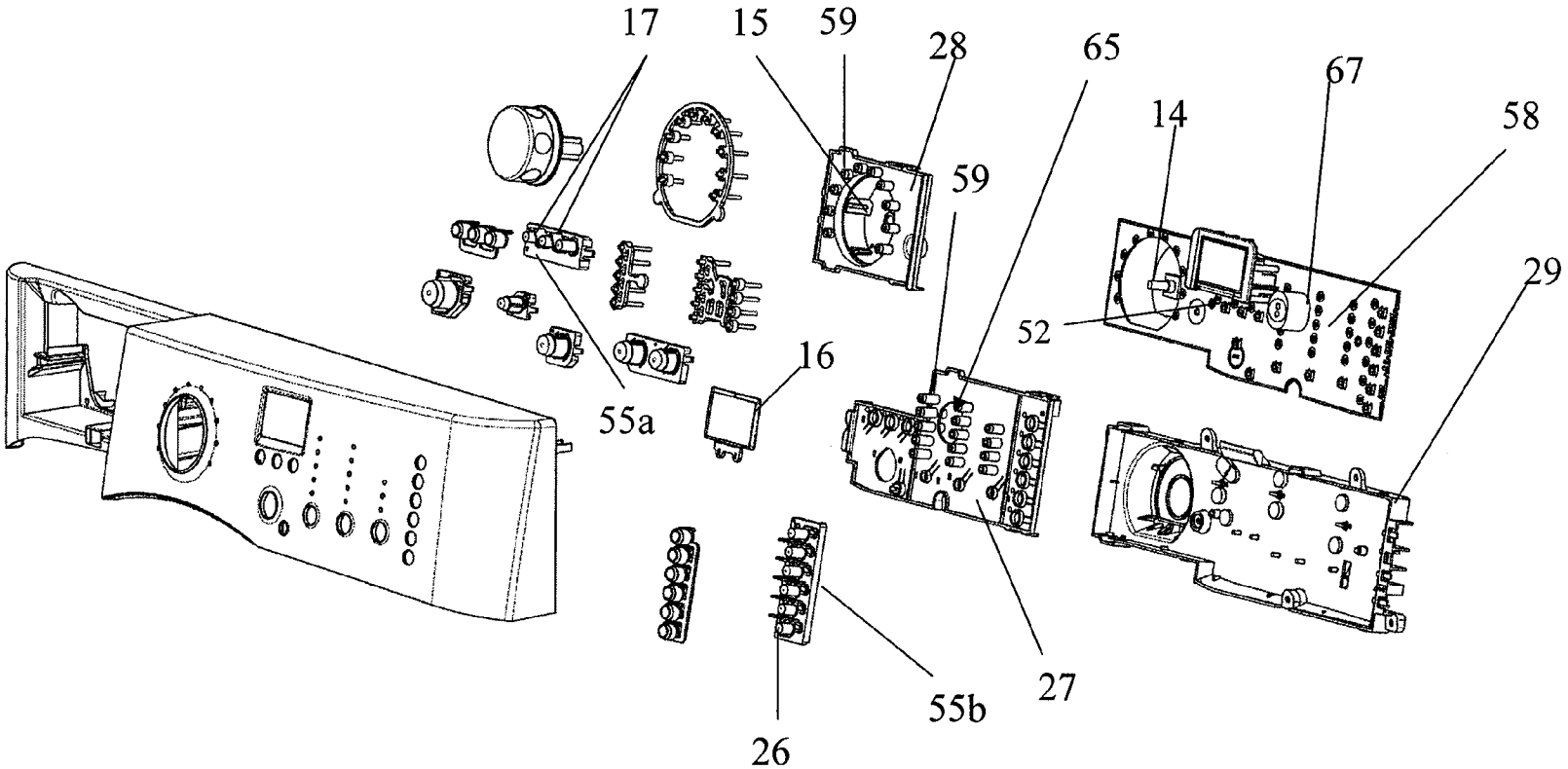
FIG. 10 is a sixth level exploded perspective view showing a further separation of control panel parts from the partially disassembled unitized assembly shown in FIG. 9.

A progressive disassembly of control panel assembly 7 is sequentially illustrated beginning with FIG. 5 and ending with FIG. 10. Referring first to FIG. 5, unitized electronics assembly 30 is shown separated rearwardly from control panel fascia 8.

Figure 6:
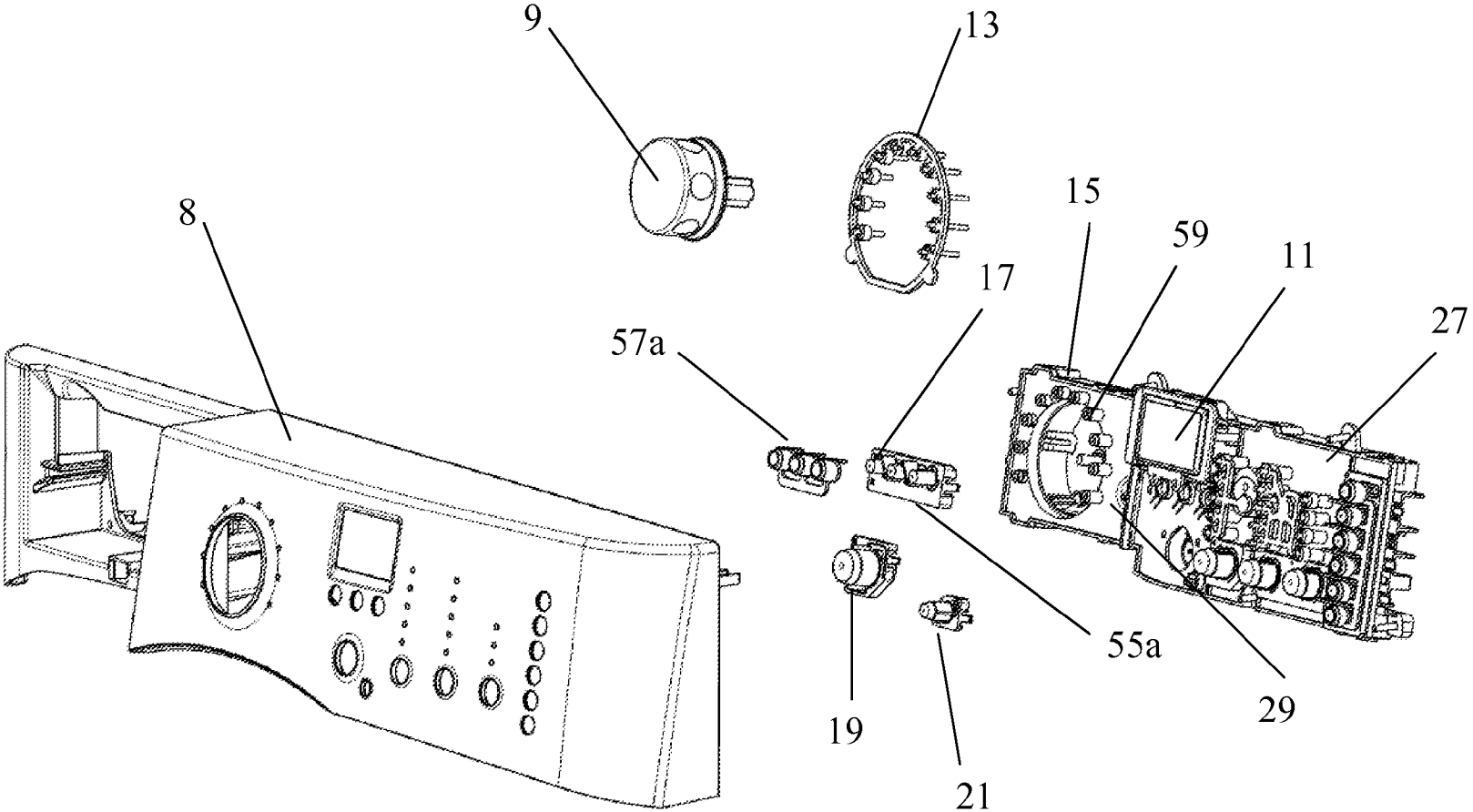
FIG. 6 is a second level exploded perspective view showing a separation of certain control panel parts from the unitized assembly shown in FIG. 5.

In FIG. 6, a disassembly of selected components from unitary electronics package 30 is illustrated, namely: control knob 9, surrounding semi-circular array of illumination elements 13, horizontally arranged push-buttons 17, relatively large operation push-button 19, and smaller push-button 21. It will be appreciated that illumination elements 13 are formed as linear, rearwardly extending light-pipes ganged together in a single, integrally molded piece, including a common planar connecting element extending in a generally circular closed loop or ring. The common connecting element may serve as a runner during injection molding of the part, e.g., from transparent thermoplastic.

Figure 7:
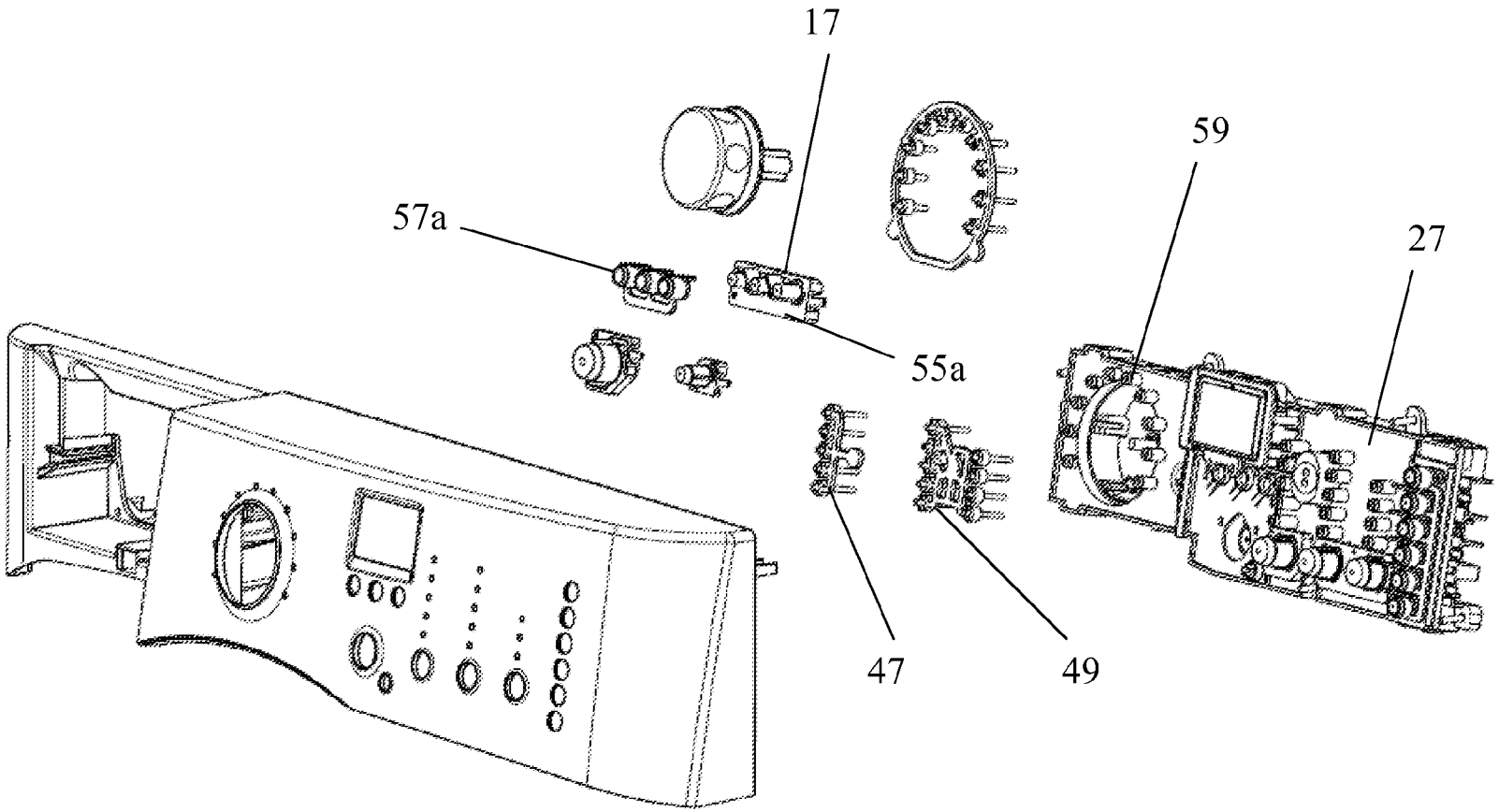
FIG. 7 is a third level exploded perspective view showing a further separation of control panel parts from the partially disassembled unitized assembly shown in FIG. 6.
Figure 8:
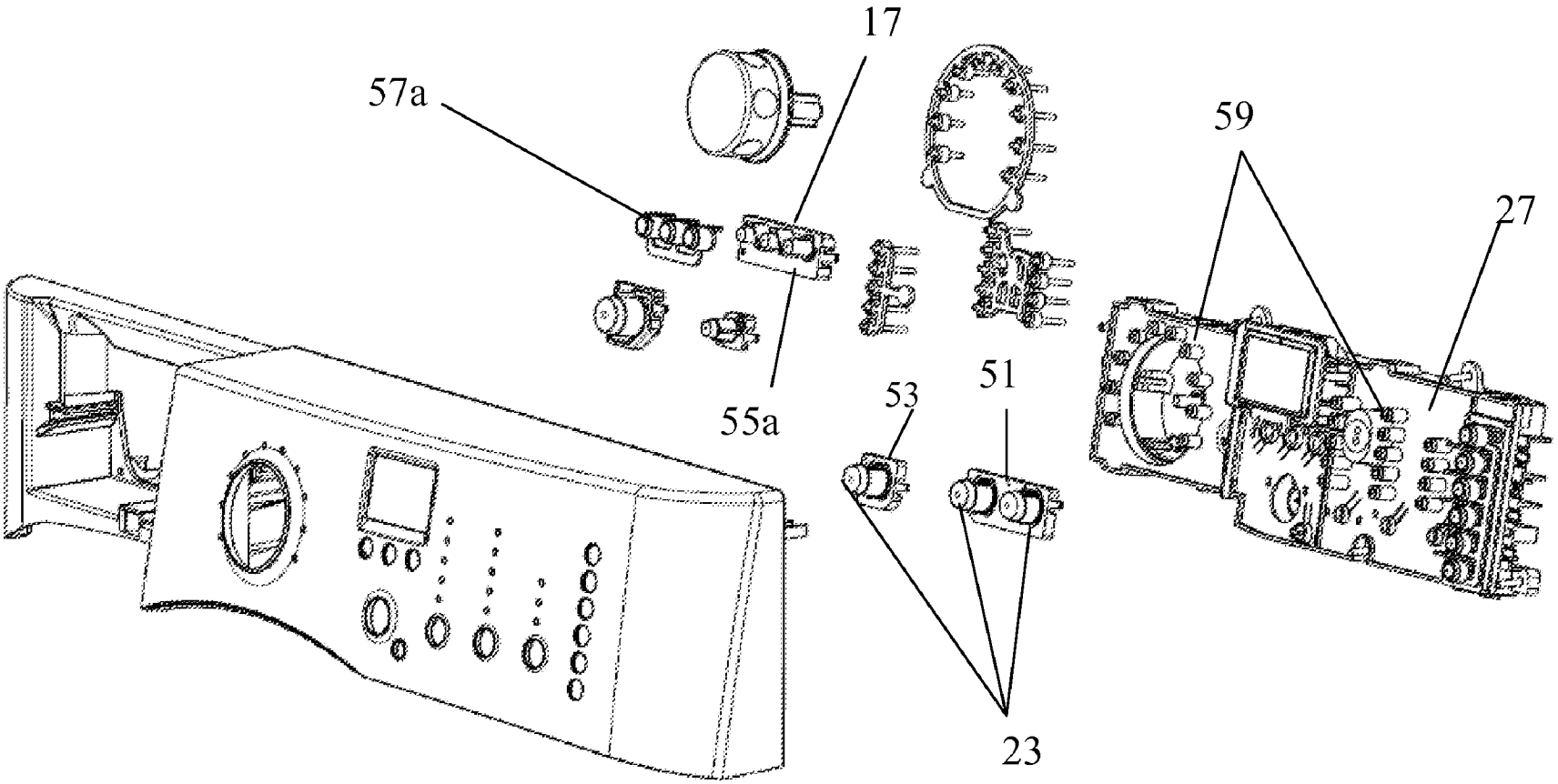
FIG. 8 is a fourth level exploded perspective view showing a further separation of control panel parts from the partially disassembled unitized assembly shown in FIG. 7.

FIG. 7 shows a further disassembly of ganged light pipe pieces 47 and 49 from front enclosure panel 27. FIG. 8 shows a further disassembly of push-buttons 23 from front-facing enclosure panel 27. In the illustrated embodiment, two of the push-buttons 23 are grouped together on (and formed as a single piece with) a common mounting base 51. The remaining one of the buttons 23 is formed singularly with an integral mounting base 53.

Figure 9:
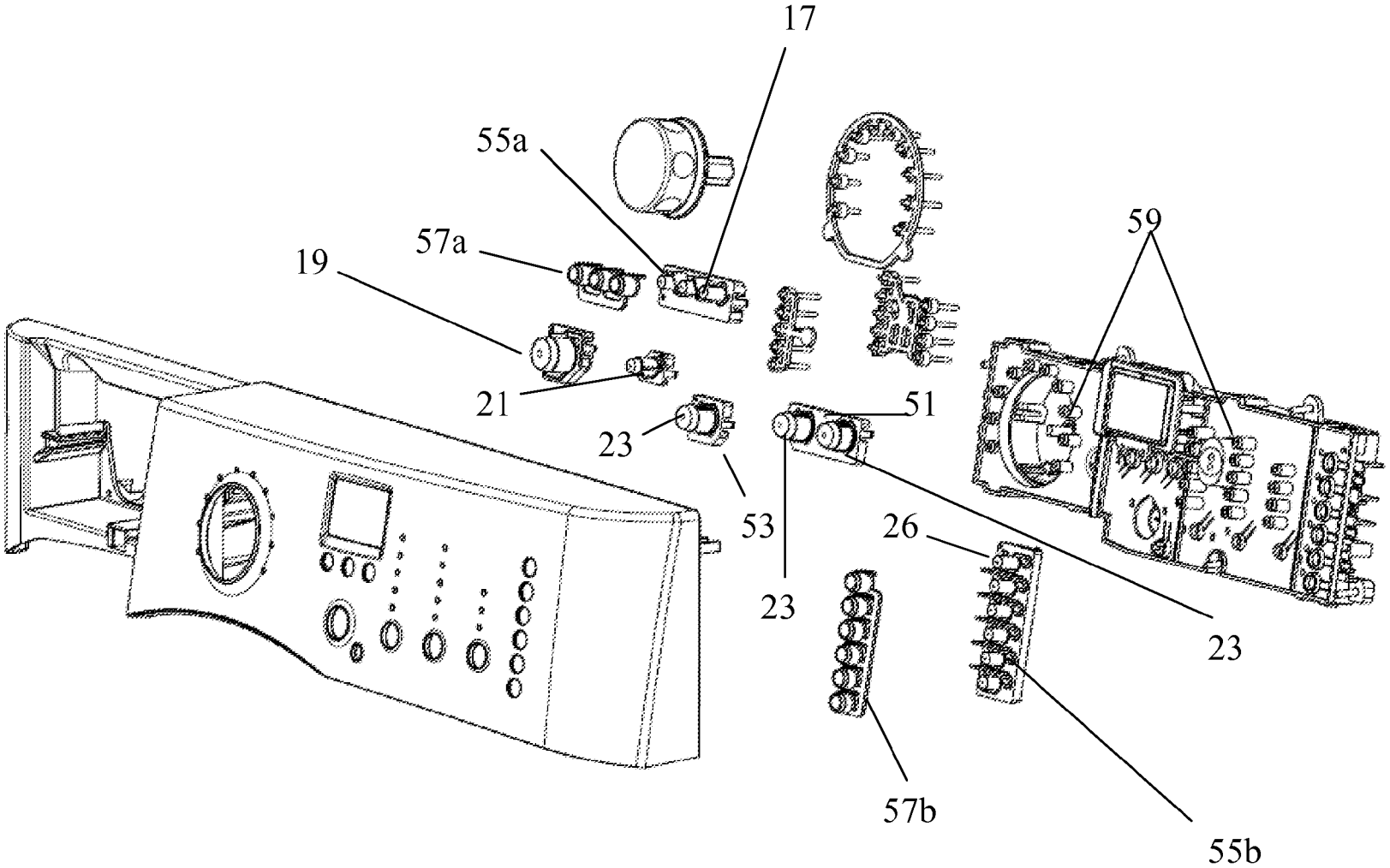
FIG. 9 is a fifth level exploded perspective view showing a further separation of control panel parts from the partially disassembled unitized assembly shown in FIG. 8.

FIG. 9 shows the further disassembly of the linear array of buttons 26 from front enclosure panel 27.

The horizontally arranged linear array of push-buttons 17, and the vertically oriented linear array of push-buttons 26, are similarly each integrally molded as a single piece. These structures are more clearly illustrated in FIGS. 9*a* and 9*b*. A common mounting platform of each piece (55*a*, 55*b*) has formed in its surface a planar spring associated with each push-button, which permits a resilient displacement and return of the button during operation. In addition, the common mounting platforms (55*a*, 55*b*) are configured to receive and mount thereon a plurality of illumination elements in the form of cylindrical sleeves, one for each button, which may similarly be ganged together in sets of three and six, i.e., formed of single pieces 57*a*, 57*b*. The sleeves, when installed, surround their respective button and have associated light pipes that extend rearwardly to respective light sources, as will be described in greater detail.

FIG. 10 shows a further disassembly of component parts from the unitized electronics assembly 30. In particular, front enclosure panels 27, 28 and PCB 58 are removed from enclosure housing 29, and transparent display screen cover 16 is removed from its mount on the rear side of control panel fascia 8.

Figure 11:
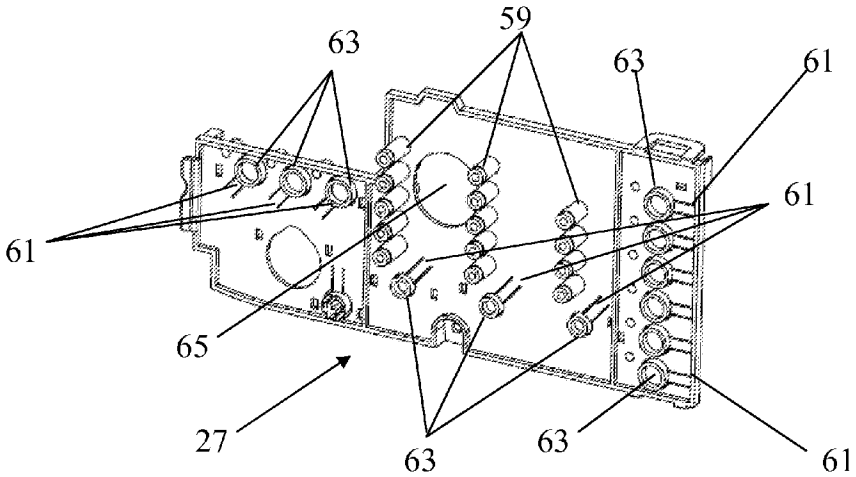
FIG. 11 is a front-side perspective view of a component-mounting electronics enclosure front panel in accordance with an aspect of the invention.
Figure 13:
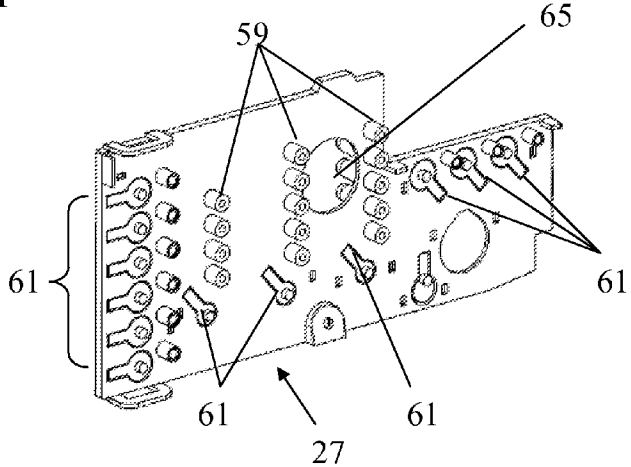
FIG. 13 is rear-side perspective view of the component-mounting electronics enclosure front panel shown in FIG. 11.
Figure 12:
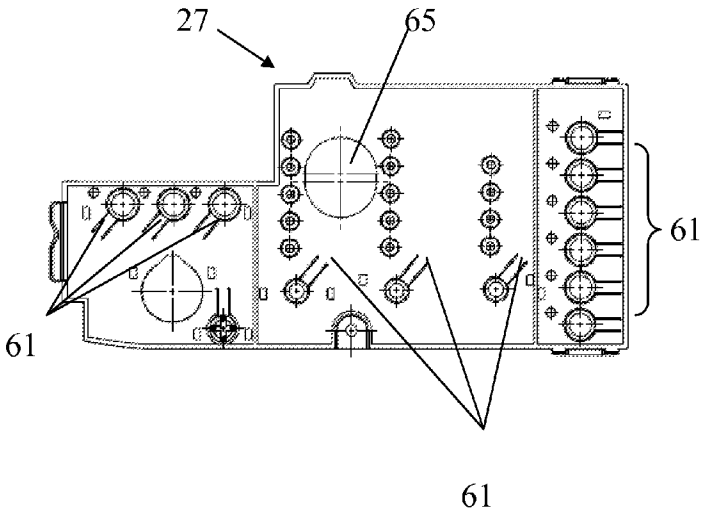
FIG. 12 is frontal elevation view of the component-mounting electronics enclosure front panel shown in FIG. 11.
Figure 14:
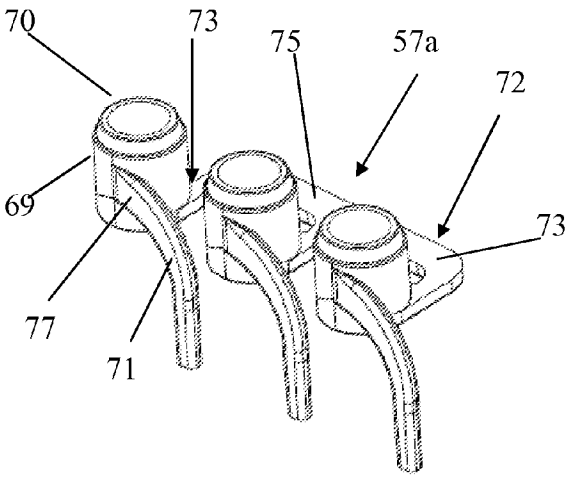
FIGS. 14 and 15 are perspective views of opposite sides of a single integrally molded light transmitting part ganging together plural sleeves and associated light pipes that provide, in conjunction with respective light sources, a series of illuminated button-surrounding rings, in accordance with an aspect of the invention.
Figure 15:
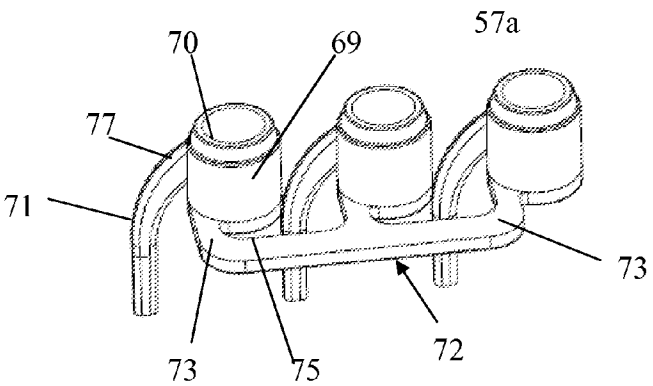
Figure 16:
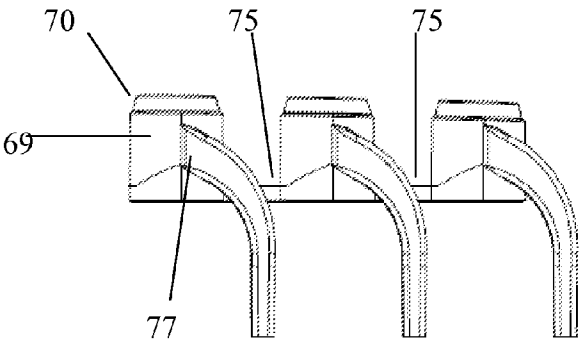
FIG. 16 is a side elevation view of the integrally molded light transmitting part shown in FIGS. 14 and 15.
Figure 17:
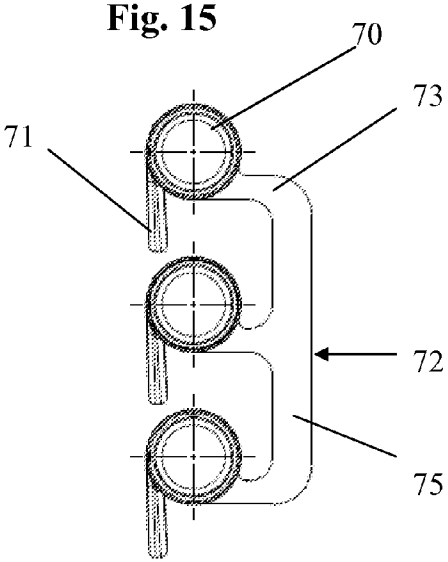
FIG. 17 is a top plan view of the integrally molded light transmitting part shown in FIGS. 14 and 15.

As mentioned, the front facing enclosure panels 27 and 28 collectively provide a mounting location for various buttons and lighted indicators that will show through the mating apertures provided in the outer control panel fascia 8. This includes light pipe receiving collars 59. The large hole 65 in front enclosure panel 27, accommodates a PCB-mounted buzzer/sound generation device 67 to provide audible user alerts, such as end-of-cycle signals. In addition, a plurality of button spring levers 61 are formed integrally as part of the front enclosure panel 27, as will now be described with reference to FIGS. 11-13.

Figure 18A:
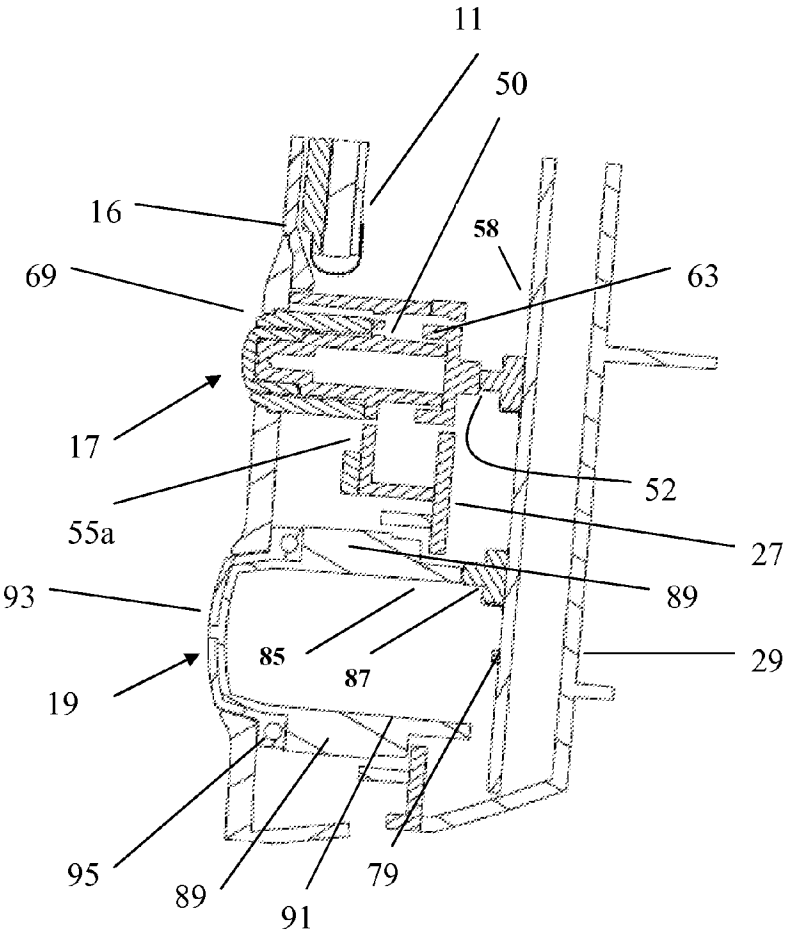
FIG. 18*a* is a section cut taken on the section line A-A shown in FIG. 2.
Figure 19:
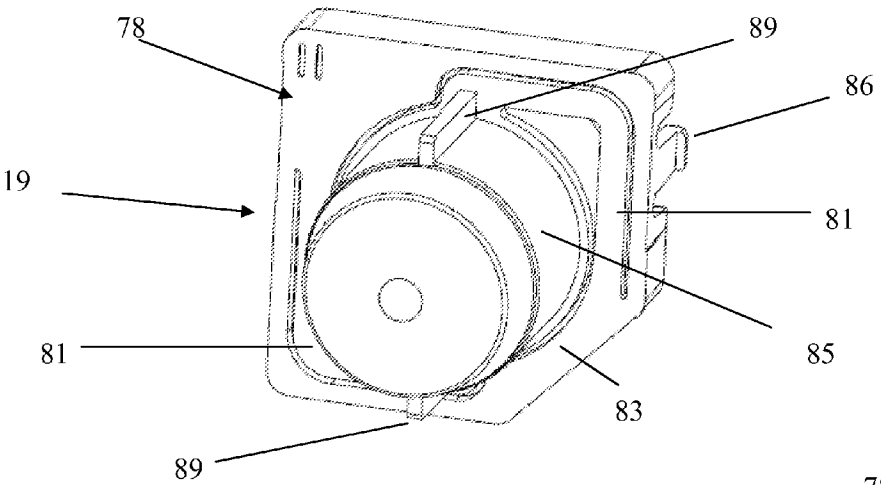
FIG. 19 is a top-side perspective view of a planar spring platform-mounted push-button part included in the assembly of FIGS. 5-10 (and also seen in FIG. 18).
Figure 21:
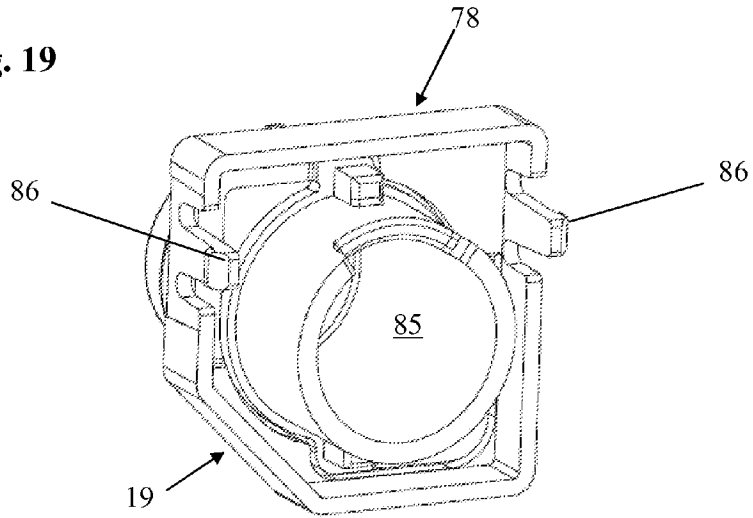
FIG. 21 is a bottom side perspective view of the push-button of FIG. 19.
Figure 20:
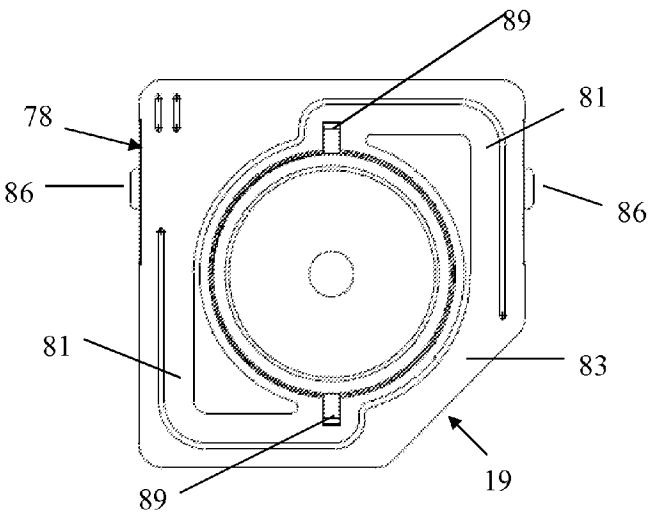
FIG. 20 is a top plan view of the push-button part of FIG. 19.

Spring levers 61 serve to provide a flexible mount for the variety of operation push-buttons included in the control panel assembly. Each includes a cantilever-mounted resilient spring arm that provides a spring bias to return its associated button to its rest position after being depressed to actuate an associated switch, and then released. An aspect of the integral spring levers 61 is that cup structures 63 are integrally molded at the free ends of the spring arms and serve an electrostatic discharge (ESD) protection function. These cups 63, formed by raised surface portions (e.g., a wall or rib) extending in a closed loop, receive in them, in a surrounding and spaced relationship, columns or posts protruding rearwardly from the centers of associated push-buttons, e.g., the three push-buttons 17, as seen in FIG. 18*a*. In the illustrated embodiment, the cups are circular, but other shapes may be used. When one of the buttons is depressed, its post pushes rearwardly on the spring lever 61, within the cup, while maintaining a spacing from the cup walls. In turn, the spring lever 61 is displaced rearwardly, and the rearward side of the associated cup actuates an associated tactile (e.g., click) switch 52 mounted on PCB 58 (see FIGS. 10 and 18*a*), which is contained within electronics enclosure housing 29. The spring arms and their associated cups 63 provide a separate structure interposed between the push-button piece and the PCB mounted switch. This structure, and particularly the relatively deep cup configuration that surrounds, and maintains a spaced relationship with, the post of the associated push-button, provides enhanced ESD protection by creating a tortuous surface path for any ESD arising due to contact of a user with one of the operation buttons on the control panel. More particularly, any charge transferred by a user contact with one of the so-configured push-buttons must travel an extended surface path with multiple turns or reversals, e.g., a 180° reversal from the bottom of the post which contacts the spring level platform, up and then back down the raised surface portions of the cup 63. In one embodiment, the raised surface portions (walls) of cup 63 have a height of 3.0 mm, found to provide a suitable balance between increasing the ESD path length on one hand, and avoiding binding during button operation on the other. In addition, the path will cross one or more interfaces between separate parts. These characteristics serve to provide improved isolation of the associated switch and other PCB-mounted components from ESD, i.e., enhanced ESD protection. This can be particularly important in the case of an embodiment as contemplated herein, in which the push-button are provided with a highly conductive user contact surface, e.g., decorative chrome plating.

Although the cup structures may be configured to serve a push-button centering or retention function in addition to their ESD protection function, this is not the purpose of the cups in the illustrated embodiment. Since other structure is provided to assure proper registry of the switch actuation mechanism, the cups 63 can be more freely configured to maintain an ESD protection-enhancing spacing between the cup walls and the push-button post or column.

In the illustrated embodiment, the buttons that mount on the spring levers 61 include, themselves, planar button springs. As mentioned, and with reference to FIGS. 9, 9*a* and 9*b*, in some cases plural buttons and associated planar springs are integrally formed as a single piece, e.g., three button set 17 on common mounting base 55*a*, the two buttons 23 on common mounting base 51, and the six buttons 26 on common mounting base 55*b*. In other cases, a single part provides a single button/planar spring combination, e.g., single button 23 on singular base 53, relatively large operation button 19, and smaller button 21. In all of these cases, the part may be snap-fittingly retained on front enclosure panel 27 by suitable means such as mating spring tabs and slots.

The mount of the planar spring button pieces on the front enclosure panel 27, over associated spring levers (an arrangement present for each button shown, except button 19, to be described separately), results in an assembly incorporating two springs per button serving to bias the associated button to its return position. This arrangement can be seen, e.g., in FIGS. 18*a* and 18*b* for button 17, including its associated common mounting platform (with planar spring) 55*a*, and spring lever 61 (with cup 63). A rearwardly protruding post portion 50 of button 17 is received within cup 63 (with a spacing between the post and cup walls, as seen in FIG. 18*a*). A press of button 17 causes deflection of the planar spring of integral mounting platform 55*a*, and the spring lever 61, to thereby cause resilient actuating contact of the backside of the lever 61/cup 63 with an associated tactile switch 52 mounted on PCB 58. In addition to assuring a positive button return action, the second planar spring formed with the button serves to keep the button post and mating cup firmly engaged, to thus avoid rattle or looseness that might otherwise result from the play between the separate parts.

Referring now to FIGS. 14-17 and 18*b*, in a further aspect, the inventive construction provides, as a single molded part 57*a*, a linear array of sleeves 69 that, upon installation, surround a corresponding linear array of control panel operation buttons, e.g., buttons 17. The piece 57*a*, providing three ganged sleeves 69 associated with the three buttons 17, are representative of various button array configurations that could be adopted in the control panel assembly, including but not limited to the linear array of six ganged button sleeves of piece 57*b*, which are associated with push-buttons 26. The sleeves 69 are light transmissive so as to provide decorative, button location identifying, illuminated rings visible on the face of control panel assembly 7, e.g., fascia 8 (see FIG. 2). In one embodiment, each ring is selectively illuminated to indicate when a corresponding option is selected.

Each sleeve is associated with an integrally formed light pipe 71 that extends rearwardly from the sleeve 69, through apertures provided in the associated button-mounting base/platform, e.g., mounting bases 55*a*, 55*b*. The stem of each light pipe 71 is sized and configured to place an end surface thereof directly in front of a corresponding LED 74 mounted on PCB 58 (see FIGS. 10 and 18*b*).

Figure 9B:
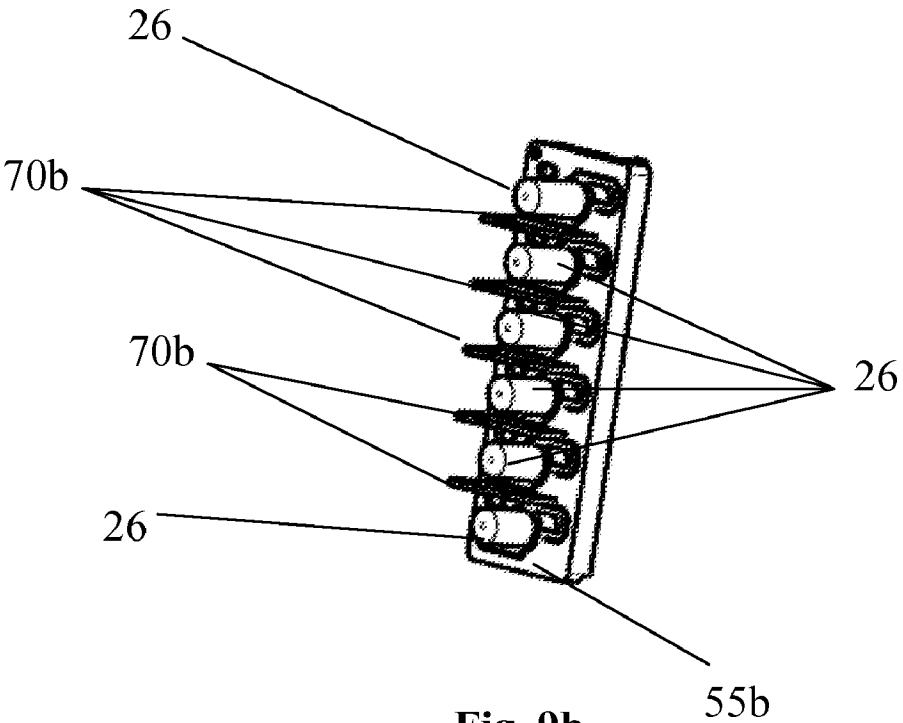
FIGS. 9*a* and 9*b* are enlarged perspective views of component parts of the control panel assembly shown in FIG. 9.
Figure 9A:
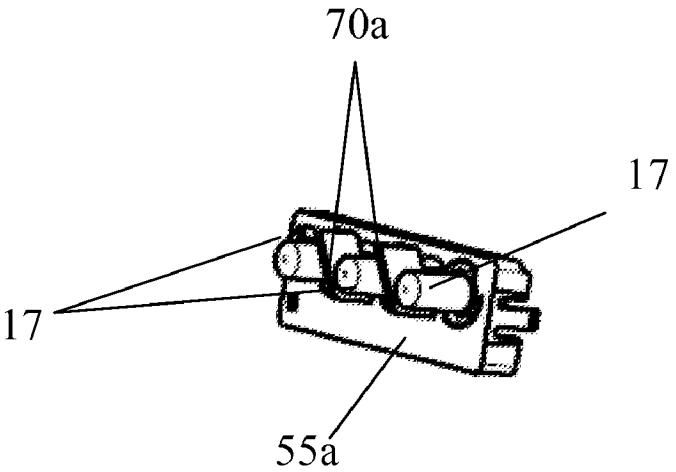

The light pipes 71 may be provided in the form of a curved and tapered stem extending rearwardly and laterally from a generally central, or further rearward, cylindrical wall portion of the sleeves 69, to the associated LEDs 74, which are offset from the central axes of their respective buttons. In the illustrated embodiments, the light pipes have a generally rectangular cross-section with rounded corners. Circular, oval or other cross-sectional shapes could be used. The light pipes transmit light from the LEDs 74 to the sleeves 69, and the sleeves transmit light along their lengths, so as to illuminate the exposed cylindrical front ends thereof in such a manner as to create a ring of light surrounding the associated button. The common mounting bases 55*a*, 55*b* may include opaque walls or blinds between the adjacent buttons in order to avoid light bleed between the illuminated buttons/sleeves, which might otherwise cause uneven lighting. Such blinds 70*a*, 70*b*, associated respectively with mounting platforms 55*a*, 55*b*, are best seen in FIGS. 9*a* and 9*b*.

The linear array of sleeves 69 and light pipes 71 are integrally molded with, and interconnected by, a common planar connecting element 72 which may serve as a runner in the molding process. The planar connecting element 72 includes relatively short, thin connecting members 73 that extend from the elongated, wider main body 75 of the planar connecting element to each of the sleeves 69. The sleeves 69, the light pipes 71 and the planar connecting element 72 may be integrally formed of the same light transmissive (e.g., transparent) plastic material, such as by injection molding. Upon installation, the sleeves 69, light pipes 71 and planar connecting element 72 are all fixed within the control panel assembly, with the sleeves in surrounding relationship with their respective buttons.

The light transmissive joint 77 between the sleeves 69 and their associated light pipes 71 is specially configured to obtain an even distribution of light around the cylindrical body of the sleeve 69, so as to emit a bright even ring of light from the opposite front end 70 of the button sleeve 69, which is exposed on the front face (fascia 8) of the control panel, in surrounding relationship with the associated button. As shown, the front end 70 has a slight taper or draft and a shoulder at its base. This configuration assists with proper flush positioning/mating of the ring 70 in a correspondingly configured hole of fascia 8. In addition, the configuration allows for a greater wall thickness, which can improve molding and increase light transmission below the surface while achieving the desired visible ring thickness above the surface. Optimally, in conjunction with some surface texturing on the visible front end (ring) 70, the configuration can be effective to substantially avoid noticeable concentrated points of light ("hot spots").

Instead of simply abutting with a rear end of the light transmissive sleeve 69 parallel to the sleeve axis, so as to point directly toward the opposite front end to be illuminated, the joining portion 77 of the light pipe 71 extends to the sleeve wall tangentially. The "direct line of sight" of the pipe is toward an opposite side of the ring and at a relatively small forward angle pointing toward a wall portion just rearwardly of the front surface of the ring, so as to direct light toward, but not directly out of, the front surface. The forward angle will vary depending, e.g., on the connection point of the pipe to the sleeve, and the length of the sleeve. In the illustrated embodiment of part 57*a*, the angle is approximately 35° , and in the illustrated embodiment of part 57*b*, the angle is approximately 16° . In addition, the joining portion 77 of the light pipe stem 71, along with the adjacent arcuate portion, flares gently to a larger width section which joins with the cylindrical sleeve wall generally tangentially. The result is that light is able to be dispersed about the circumference of the sleeve 69 and be evenly transmitted to the exposed end (ring) 70 to be illuminated. The configuration generally directs the light in such a circumferential, forwardly directed, manner as to "spiral" along the cylindrical walls of the sleeve from the point of entry to the opposite front end (ring) 70 to be illuminated.

With reference now to FIGS. 18*a* and 19-21, in another aspect, the invention provides a push-button 19 with an integrally formed planar spring mounting base 78, that may be backlit, such as by one or more PCB mounted LEDs 79 (FIG. 18*a*). In the design, the elastic arms 81, which connect the button 19 to the surrounding support 83, comprise linear segments extending at right angles to each other and tangentially of the circular button 19, so as to form substantially rectangular inside corners.

The button body includes a tubular (e.g., cylindrical) portion 85 extending rearwardly from the depressible face of the button 19, through the spring plane and beyond the mounting base 78. The mounting base 78 allows the button body to be mounted on front panel 27 of the electronics enclosure housing 29, such as with resilient spring tabs 86. When so mounted, and as seen in FIG. 18*a*, the tubular portion 85 extends through an aperture in the front panel 27, so as to contact, when the button is pressed, associated switch 87 mounted on PCB 58, which is spaced behind the spring plane of platform 78, within the electronics enclosure housing 29. In addition to providing a switch actuation mechanism, the tubular extension serves to capture and direct to the button face, light emitted from LED 79 mounted on PCB 58 behind the button, to thereby provide an effective back-lighting functionality. In addition, the tubular body 85 carries on its cylindrical outer surface a pair of ribs 89. The ribs 89 extend lengthwise along the tubular button body toward (but short of) the front face of the button, so as to prevent the button from extending through the front panel (fascia) 8 too far.

FIG. 18*a* shows a modified construction of button 19, formed in a 2-shot injection molding process. In this embodiment, a main base portion 91 may be formed of transparent polycarbonate; an over molded cap portion 93 may be formed of ABS, and that part may be chrome-plated. An icon, such as is visible on the face of button 19 seen in FIG. 2, may be formed as part of the transparent base portion 91. This exposed polycarbonate portion will resist plating and thus leave a transparent portion in the shape of the icon, which may then be backlit with LED 79. In this embodiment, the overmolded portions of ribs 89 are formed with a pair of through holes which serve as attachment locations for electrode clips used in the plating process.

In the illustrated embodiments, the control panel assembly and components are implemented in a control panel of an automated laundry washing machine and dryer. It will be understood, however, that aspects of the invention may be applied to other automatic washing/drying appliances, e.g., dishwashing machines, and to electronic appliances in general.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. An appliance control panel assembly, comprising:

a control panel fascia;

a plurality of push-buttons presented in apertures of said fascia; and a unitized electronics enclosure assembly mated with a rear side of said control panel fascia, said electronics enclosure assembly including a rear electronics enclosure housing; a printed circuit board (PCB) contained within said housing, said PCB having electronic control panel components mounted thereon, including at least one switch; and a front enclosure panel engaged with said housing so as to cover a substantial front side portion of said PCB, said front enclosure panel comprising at least one integrally formed spring member associated with at least one of said plurality of push-buttons and operable to permit said push-button to be pressed against a bias of said spring member to releasably actuate said at least one switch, said integrally formed spring member including a moveable platform engageable with a rearward portion of said push-button, said moveable platform being formed with raised surface portions extending in a closed loop so as to surround, in spaced relation, a contact region of said rearward portion of the push-button with said moveable platform.

2. An appliance control panel assembly according to claim 1, wherein said raised surface portions together with said platform form a circular cup for receiving, in surrounding spaced relationship, said rearward portion of the push-button.

3. An appliance control panel assembly according to claim 1, wherein said push-button is mounted on said front enclosure panel so as to form a part of said unitized electronics enclosure assembly.

4. An appliance control panel assembly according to claim 3, wherein said push-button is integrally formed with a mounting base that attaches to said front enclosure panel in overlying relationship to said spring member.

5. An appliance control panel assembly according to claim 4, wherein said mounting base incorporates a second spring member upon which said push-button is mounted, to permit said button to be resiliently displaced relative to said mounting base.

6. An appliance control panel assembly according to claim 5, wherein said second spring member is a planar spring integrally formed as part of a platform of said mounting base.

7. An appliance control panel assembly according to claim 5, wherein said second spring member serves to bias said contact region of said rearward portion of the push-button against said platform within said closed loop.

8. An appliance control panel assembly according to claim 5, wherein each of said integrally formed spring members and said second spring member is resiliently displaced during a depression of said push-button to actuate said switch.

9. An appliance control panel assembly according to claim 1, wherein said integrally formed spring member comprises a cantilever-mounted spring lever.

10. An appliance control panel assembly according to claim 9, wherein said platform is formed at the free end of said spring lever.

11. An appliance control panel assembly according to claim 1, said front enclosure panel further comprising a plurality of integrally formed collars, said appliance control panel assembly further comprising a plurality of light pipes received within said collars, and having rearward ends positioned adjacent associated light sources mounted on said PCB.

12. An appliance control panel assembly according to claim 11, wherein said light pipes have front ends received in associated apertures of said fascia.

13. An appliance control panel assembly according to claim 12, wherein the front end of at least one of the light pipes is provided in the form of a sleeve received in an associated aperture of said fascia in surrounding relationship with one of said push-buttons.

14. An appliance control panel assembly according to claim 11, wherein said light sources comprise light emitting diodes (LEDs).

15. An appliance control panel assembly, comprising:

a control panel fascia;

a plurality of push-buttons presented in apertures of said fascia; and a unitized electronics enclosure assembly mated with a rear side of said control panel fascia, said electronics enclosure assembly including a rear electronics enclosure housing; a printed circuit board (PCB) contained within said housing, said PCB having electronic control panel components mounted thereon, including at least one switch; and a front enclosure panel engaged with said housing so as to cover a substantial front side portion of said PCB, said front enclosure panel comprising at least one integrally formed spring member associated with at least one of said plurality of push-buttons and operable to permit said push-button to be pressed against a bias of said spring member to releasably actuate said at least one switch, said integrally formed spring member being engageable with a rearward portion of said push-button, wherein said push-button includes a second spring member distinct from, and positioned forwardly toward said fascia relative to, said integrally formed spring member.

16. An appliance control panel assembly according to claim 15, wherein said push-button is mounted on said front enclosure panel so as to form a part of said unitized electronics enclosure assembly.

17. An appliance control panel assembly according to claim 16, wherein said push-button is integrally formed with a mounting base that attaches to said front enclosure panel in overlying relationship to said spring member of the front panel.

18. An appliance control panel assembly according to claim 17, wherein said second spring member is a planar spring integrally formed as part of a platform of said mounting base.

19. An appliance control panel assembly according to claim 15, wherein said second spring member serves to bias a contact region of said rearward portion of the push-button against said integrally formed spring member.

20. An appliance control panel assembly according to claim 15, wherein both said integrally formed spring member and said second spring member are resiliently displaced during a depression of said push-button to actuate said switch.

21. An appliance control panel assembly according to claim 15, wherein said integrally formed spring member comprises a cantilever-mounted spring lever.

* * * * *